US006796698B2

(12) United States Patent
Sommers et al.

(10) Patent No.: US 6,796,698 B2
(45) Date of Patent: Sep. 28, 2004

(54) LIGHT EMITTING DIODE-BASED SIGNAL LIGHT

(75) Inventors: Mathew Sommers, Sagamore Hills, OH (US); Patrick Martineau, Montreal (CA)

(73) Assignee: GELcore, LLC, Valley View, OH (US)

( * ) Notice: Subject to any disclaimer, the term of this patent is extended or adjusted under 35 U.S.C. 154(b) by 0 days.

(21) Appl. No.: 10/063,224

(22) Filed: Apr. 1, 2002

(65) Prior Publication Data

US 2003/0185005 A1 Oct. 2, 2003

(51) Int. Cl.[7] ..... G08B 7/04

(52) U.S. Cl. ..... 362/555; 362/303; 362/800; 362/247; 340/815.45

(58) Field of Search ..... 362/339, 340, 362/303, 298, 302, 305, 240, 255, 256, 800, 236, 293, 307, 331, 226, 241, 245, 247, 327, 335, 338; 340/907, 815.45, 815.67, 641, 642; 313/500, 511, 512, 113, 114; 116/63 R

(56) References Cited

U.S. PATENT DOCUMENTS

| | | | | | |
|---|---|---|---|---|---|
| 3,774,021 | A | * | 11/1973 | Johnson | 362/27 |
| 4,195,330 | A | * | 3/1980 | Savage, Jr. | 362/226 |
| 4,727,289 | A | * | 2/1988 | Uchida | 315/71 |
| 5,594,433 | A | * | 1/1997 | Terlep | 362/555 |
| D388,726 | S | | 1/1998 | Wu | |
| 5,782,555 | A | | 7/1998 | Hochstein | 362/373 |
| 5,850,126 | A | * | 12/1998 | Kanbar | 315/200 A |
| 5,865,529 | A | * | 2/1999 | Yan | 362/327 |
| 5,898,381 | A | | 4/1999 | Gartner et al. | 340/815.65 |
| 6,019,493 | A | * | 2/2000 | Kuo et al. | 362/335 |
| 6,036,336 | A | * | 3/2000 | Wu | 362/249 |
| 6,054,932 | A | | 4/2000 | Gartner et al. | 340/815.65 |
| 6,149,283 | A | * | 11/2000 | Conway et al. | 362/236 |
| 6,227,679 | B1 | * | 5/2001 | Zhang et al. | 362/236 |
| 6,268,801 | B1 | | 7/2001 | Wu | 340/815.45 |
| 6,283,613 | B1 | | 9/2001 | Schaffer | 362/245 |
| 6,292,901 | B1 | * | 9/2001 | Lys et al. | 713/300 |
| 6,488,392 | B1 | * | 12/2002 | Lu | 362/308 |
| 2002/0021573 | A1 | * | 2/2002 | Zhang | 362/555 |

FOREIGN PATENT DOCUMENTS

KR 2001000635 * 1/2001

* cited by examiner

*Primary Examiner*—Thomas M. Sember
*Assistant Examiner*—Hargobind S. Sawhney
(74) *Attorney, Agent, or Firm*—Fay, Sharpe, Fagan, Minnich & McKee, LLP

(57) ABSTRACT

A light-emitting diode-based light source (40) for retro-fitting into a traffic signal lamp (10) employing an incandescent light bulb (12) includes at least one light emitting diode (LED) (46), a dispersing reflector (62) cooperating with the at least one LED (46) to adapt light (60) produced by the at least one LED (46) for receipt by optics of the traffic signal lamp (10), and a screw-type electrical connector (42) adapted to mate with a threaded socket connector (18) of the traffic signal lamp (10). The screw-type electrical connector (42) is adapted to transmit electrical power to the at least one LED (46). A method (100) is provided for the retro-fitting, including the step (104) of removing the threaded light bulb (12) from the threaded socket (18), and the step (106) of connecting the threaded LED light source (40) into the threaded socket (18).

14 Claims, 4 Drawing Sheets

LIGHT EMITTING DIODE-BASED SIGNAL LIGHT

BACKGROUND OF INVENTION

The invention relates to the lighting arts. It is especially applicable to the retro-fitting of incandescent light source-based traffic signals with higher efficiency and a more durable light emitting diode (LED)-based light source, and will be described with particular reference thereto. However, the invention will also find application in numerous types of lamps, flashlights, and other illuminators which presently employ inefficient incandescent or fluorescent light bulbs that have high failure rates principally due to filament fragility or fluorescent tube failure. The invention provides LED-based light sources which are safer and have improved versatility and greater compatibility with existing lighting standards.

With reference to FIG. 1, a conventional traffic signal ball 10 such as is used in the ubiquitous three-color (red, yellow, green) traffic control signal is schematically shown. The traffic signal ball 10 is suitable for providing the red, yellow, or green light of a three-color traffic signal, and includes an incandescent light bulb 12 which emits light via a filament 14 which glows when driven by an electrical current. The light bulb 12 includes a threaded electrical connector 16 adapted for connection to a threaded socket 18. The threaded socket 18 and the threaded electrical connector 16 cooperate to transmit electrical power from electrical conductors 20 to the filament 14. Light produced by the light bulb 12 is collected by traffic signal optics including a reflector 22, which is typically a parabolic reflector, and a lens 24 to produce a light beam outwardly directed from the traffic signal ball 10 with a suitable beam spread. The beam spread should be narrow enough to direct the light toward roadway users with a high degree of efficiency, but wide enough so that roadway users including pedestrians at the periphery of the road and drivers a substantial distance from the intersection can readily see the signal.

The aforementioned components are arranged within a traffic signal ball housing 26 having a cover 28 which typically includes the lens 24. The cover 28 is selectively opened, typically in a hinged manner, to provide access to the light bulb 12 for bulb replacement. The cover 28 optionally includes additional elements such as a visor or a tinted filter (elements not shown) for spectrally filtering the light to produce a red, green, or yellow output. The tinted filter is optionally incorporated into the lens 24 by tinting the lens material. The light bulb 12 typically produces a white light which is colored by passing through the tinted filter or tinted lens 24 to produce one of the red, yellow, and green lights of a known three-ball traffic light. For traffic signal balls providing a shaped light such as a left turn arrow, an "X" lane marker indicating "wrong way", a pedestrian "walk" or "don't walk" signal, or the like, a masking filter (not shown) is typically included with the cover 28 to define the selected shape.

The conventional incandescent traffic signal ball 10 suffers from some disadvantages. The light bulb 12 frequently fails, usually due to a failure of the filament 14. Light bulb replacement is inconvenient, and the intersection is uncontrolled or improperly controlled and unsafe until the failed light bulb 12 is replaced. Furthermore, those skilled in the art will appreciate that the optical components such as the reflector 22 and the lens 24 which direct the white light produced by the light bulb 12 toward roadway traffic can also operate to reflect sunlight or other external light sources outward toward traffic, with the reflected light tinted according to the tinted filter or lens 24. Re-directed external light, known as "phantom" light, can confuse roadway users into believing the traffic signal ball 10 is lit when it is not. In some incandescent traffic signal balls, an anti-phantom optical component is included to reduce phantom light. In spite of these disadvantages, however, incandescent traffic light signals are the predominant technology in use today.

The frequency of light source replacement in a traffic light can be reduced by replacing the light bulb 12 with a light source employing light emitting diodes (LEDs), which are more durable and longer-lasting than incandescent sources. However, retro-fitting the traffic signal ball 10 with an LED-based light source is complicated by the very different electrical and optical characteristics of the LED versus the incandescent source. The light bulb filament 14 acts as an approximate point or line light source, and the optics of the traffic signal ball 10 are designed around such a source. An LED, in contrast, produces generally forwardly directed light. Furthermore, a single LED typically exhibits low optical power output, and so LED-based light sources usually employ a plurality of LEDs, further complicating attempts to shape the light distribution using conventional traffic signal ball optics.

A number of LED-based light sources have been developed for retro-fitting a conventional incandescent traffic signal ball 10. Examples can be found in U.S. Pat. Nos. Des. 388,726 and 6,268,801 both issued to Wu, U.S. Pat. No. 6,283,613 issued to Schaffer, U.S. Pat. No. 6,054,932 issued to Gartner et al., U.S. Pat. No. 5,898,381 issued to Gartner et al., and U.S. Pat. No. 5,782,555 issued to Hochstein. These LED-based light sources employ arrays of LEDs distributed to substantially conform to the desired light shape (a round circle or a left-turn arrow, for example) mounted onto a cover that replaces the cover 28 of the traffic signal ball 10. These sources retro-fit the cover 28, and therefore are configured to match the size, shape, and attachment mechanism of the cover 28. As a result, these sources are highly specific to the signal ball being retro-fitted, and have limited interchangeability. Since the replacement of an incandescent source by an LED source is typically performed in the field under tight time constraints, the maintenance crew must ascertain beforehand exactly which LED light source is needed, and obtain that source.

Another disadvantage of past methods for LED-based retro-fitting of the incandescent signal ball 10 is that it fails to make use of the existing components of the incandescent signal ball 10. Schaffer (U.S. Pat. No. 6,283,613), for example, points out that typical LEDs without associated optics produce a light beam with spatial characteristics that do not comply with Institute of Transportation Engineers (ITE) requirements and other regulations, and teaches incorporating individual optics associated with each LED in the retro-fit array. This introduces additional cost to the LED-based source and does not make use of the existing signal ball optics. Similarly, some past retro-fit methods have required extensive re-wiring of the electrical connections within the traffic light, negating the convenience, simplicity, and speed of conventional light bulb replacement.

Yet another disadvantage associated with some past LED retro-fitting methods is that, because at least the cover 28 is replaced, the signal ball 10 is no longer suitable for operation with an incandescent source. In some retro-fits, the reflector and other optical components are additionally removed. In view of the present predominance of incandescent light sources in traffic signaling, the practical and commercial viability of LED retro-fitting is hindered by retro-fitting which renders the traffic light unsuitable for use with incandescent light bulbs.

The present invention contemplates an improved LED-based light source apparatus and method for retro-fitting an incandescent signal light therewith that overcomes the above-mentioned limitations and others.

SUMMARY OF INVENTION

In accordance with one embodiment of the present invention, a traffic signal ball is disclosed, including a lamp having a plurality of LEDs, an optical element arranged to disperse forwardly directed light produced by the LEDs, and a threaded electrical connector. The lamp also includes an optical system that receives light dispersed by the optical element and forms at least a portion of the received light into an outwardly directed beam.

In accordance with another embodiment of the present invention, a method is provided for retro-fitting a traffic signal lamp with a threaded LED light source. The traffic signal lamp has a threaded light bulb, a threaded socket for receiving and powering the light bulb, and optics configured to direct light produced by the light bulb in a generally forward direction. The method includes the steps of removing the threaded light bulb from the threaded socket, and connecting the threaded LED light source into the threaded socket. The threaded LED light source includes: a threaded electrical connector adapted for mechanical and electrical connection to the threaded socket; at least one light emitting diode (LED); a heat-sinking element for removing heat from the at least one LED; electrical conditioning circuitry that receives electrical power from the threaded electrical connector and conditions the electrical power to operate the at least one LED; and an optical element optically communicating with the at least one LED for distributing light produced by the at least one LED in conformance with the traffic signal lamp optics.

In accordance with another embodiment of the present invention, a light-emitting diode-based light source is disclosed, for retro-fitting into a traffic signal lamp employing an incandescent light bulb. The light-emitting diode-based light source includes at least one light emitting diode (LED), a reflector cooperating with the at least one LED to adapt light produced by the at least one LED for receipt by optics of the traffic signal lamp, and a screw-type electrical connector adapted to mate with a threaded socket connector of the traffic signal lamp. The screw-type electrical connector is adapted to transmit electrical power to the at least one LED.

In accordance with yet another embodiment of the present invention, an LED-based light source is disclosed. A threaded electrical connector is arranged to receive electrical power. Power converting electronics receive the electrical power and convert the electrical power to converted power. A plurality of LEDs receives the converted power. The LEDs produce a generally forwardly directed first light beam responsive to receipt of the converted power. A light dispersing element is arranged at a focal region of a reflector and intercepts and transforms the first light beam into dispersed light emanating from the focal region. An optical system is arranged to focus the dispersed light emanating from the focal region into an output light beam having selected beam characteristics. The threaded electrical connector, the plurality of LEDs. the light dispersing element, the collimating reflector. and the lens comprise a unitary threadedly connectable light source.

In accordance with still yet another embodiment of the present invention, a lamp is disclosed for use in a light producing apparatus having a socket through which power is supplied to the lamp, which socket also holds the lamp, and an optical system including a reflector and a lens which cooperate to direct light outwardly from the light producing apparatus. The lamp includes a connector by which the lamp is installed in the socket, a number of LEDs electronically connected to the connector, and a redirection element arranged to redirect light emitted from the number of LEDs such that the redirected light is coupled into the optical system of the light producing apparatus.

One advantage of the present invention is that it replaces the light bulb of a traffic light ball or other incandescent lighting system with an LED-based light source in a manner which utilizes the existing optical and electrical components which are adapted for use with the light bulb, such as the reflector, lens, and electrical socket. This enables the lighting system to be optionally re-fitted with an incandescent light bulb at a later date in the usual manner.

Another advantage of the present invention resides in the operative cooperation of the present LED-based light source with the existing optics and filters of the traffic light ball. Filters providing selected color or graphical features (such as turn arrows or lane "X" indicators) are operatively retained, and so the LED-based light source is usable in many types of traffic light balls and in any of the red, yellow, or green signals. This simplifies field maintenance and reduces the number and type of LED-based light sources in traffic department inventories.

Yet another advantage of the present invention is that the LED-based light source includes a conventional threaded electrical connector and can be installed in the traffic light ball with the traffic light ball fully energized. The conventional threaded connector increases worker safety during installation, and the ability to perform the installation without first de-energizing the traffic light simplifies the installation process and reduces traffic delays.

Numerous other advantages and benefits of the present invention will become apparent to those of ordinary skill in the art upon reading and understanding the following detailed description.

BRIEF DESCRIPTION OF DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION

Figure 1:
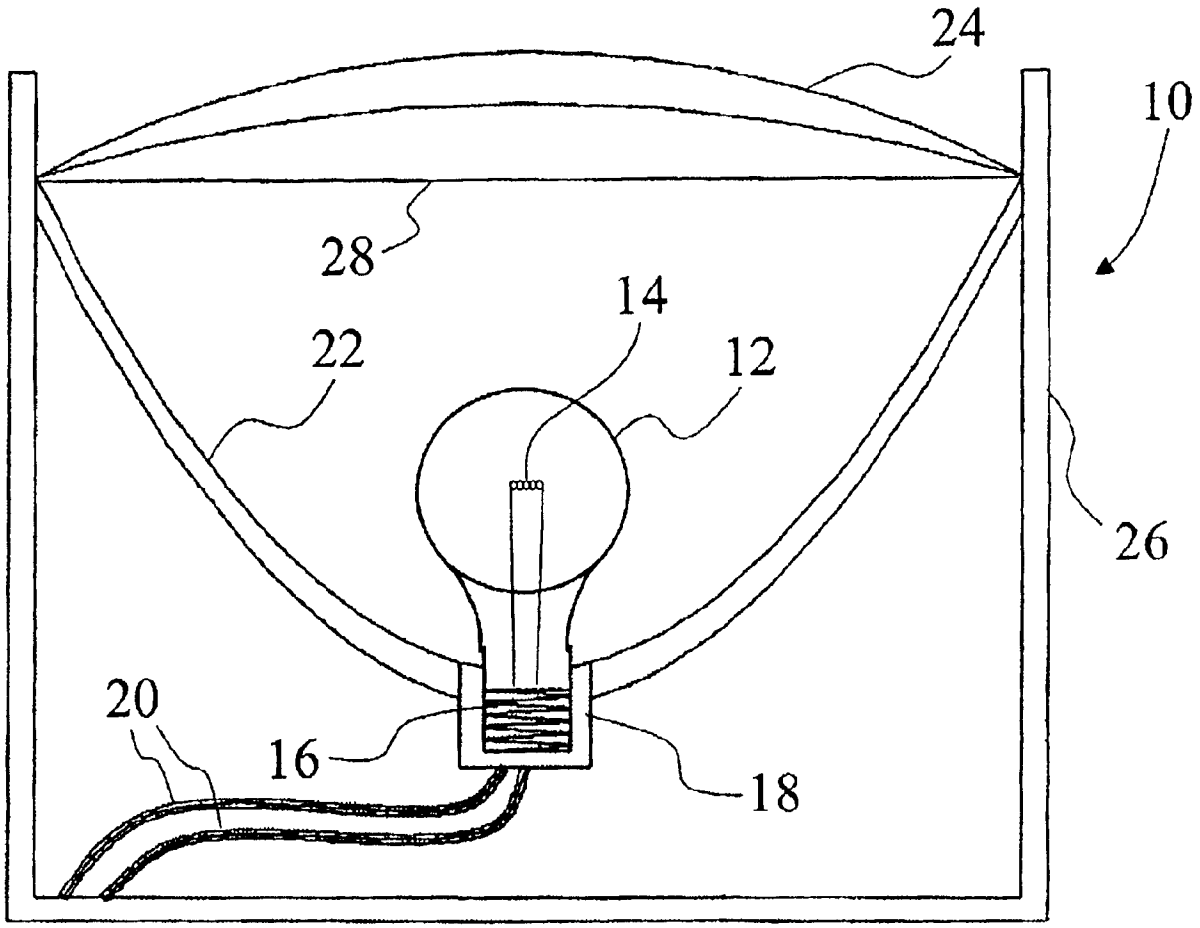
FIG 1 (Prior Art)
FIG. 1 shows a prior art traffic signal ball employing an incandescent light bulb.
Figure 2:
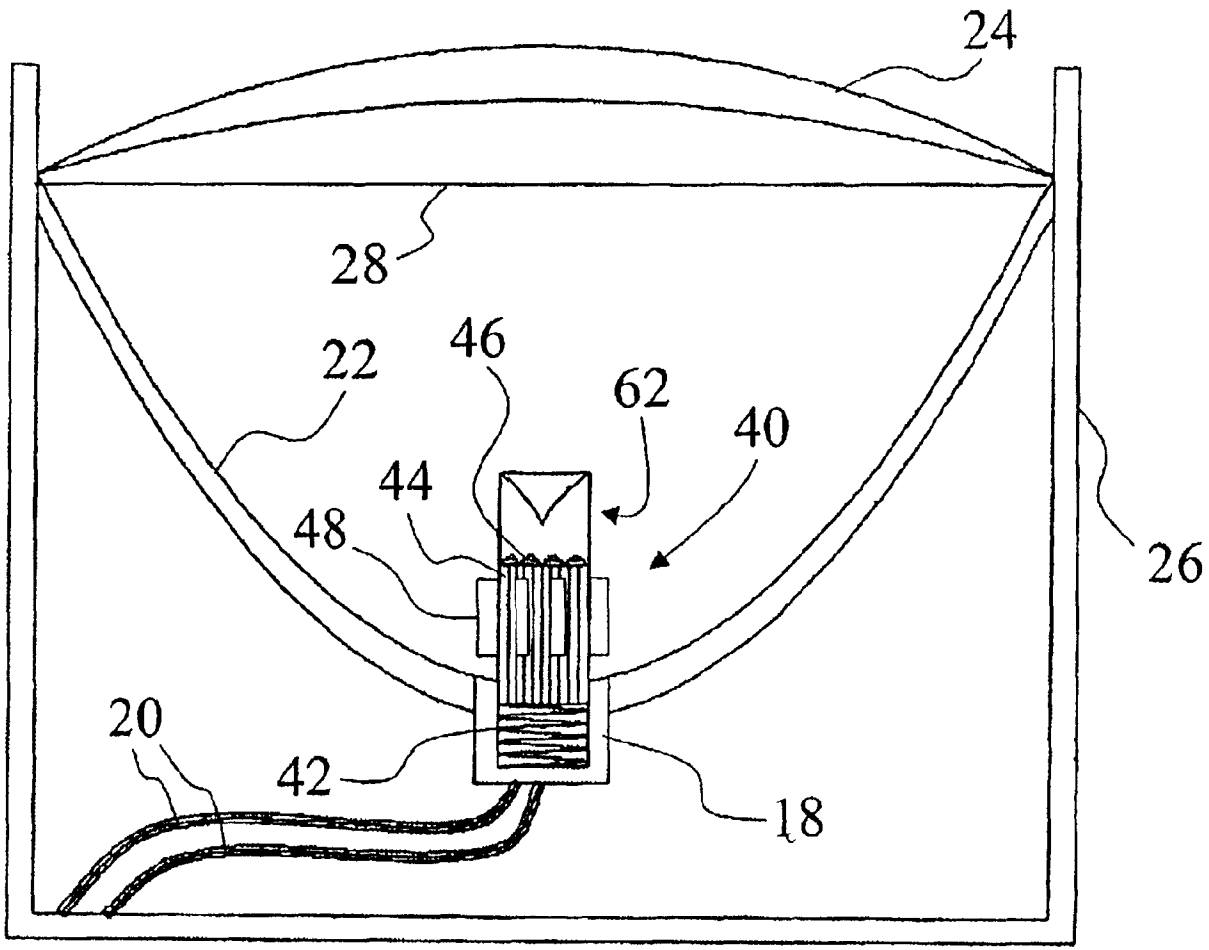
FIG. 2 shows a traffic signal ball for employing an incandescent light bulb retro-fitted with a light-emitting diode-based light source according to an embodiment of the invention.
Figure 3:
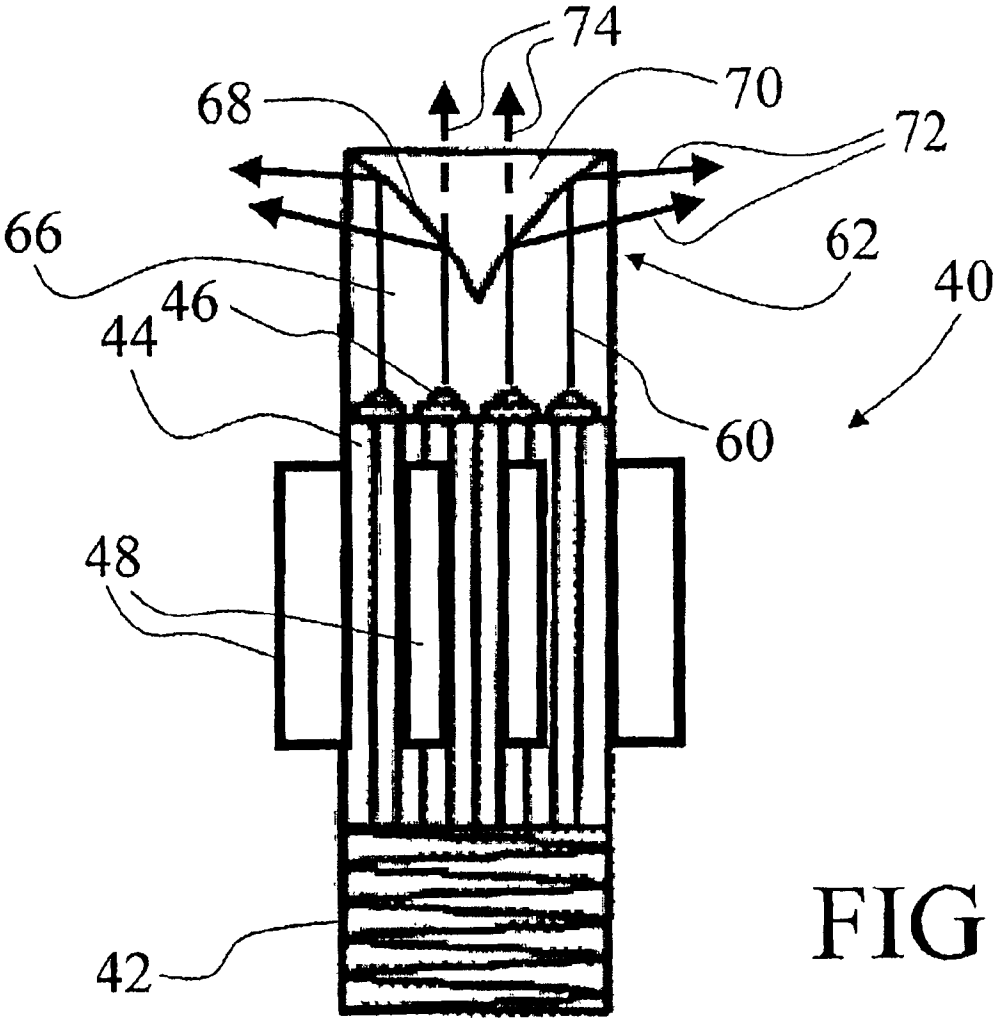
FIG. 3 shows the light-emitting diode-based light source of FIG. 2.

With reference to FIGS. 2 and 3, an LED-based light source 40 is employed in a traffic light ball 10, such as shown in FIG. 1. The LED-based light source 40 replaces only the light bulb 12 of FIG. 1. The cover 28 and the existing optics such as the reflector 22 and the lens 24 are physically and functionally retained as seen in FIG. 2.

The source 40 includes a threaded electrical connector 42 that mechanically and electrically conforms with the connector 16 of the light bulb 12, so that the source 40 is installed into the threaded socket 18 similarly to the light bulb 12, that is, by screwing the source 40 into the socket 18 to effect electrical connection and mechanical support. The LED-based lamp 40 also includes electrical power conditioning electronics 44. As is known to those skilled in the art, incandescent traffic lights are typically powered by a.c. electrical voltage sources in the range of about 80–135 volts (for the nominally 120V a.c. North American standard) or about 185–275 volts (for the nominally 220V European standard), and typically draw hundreds of milliamperes of current. The LED source 40, in a suitable embodiment, includes a plurality of LEDs 46 each operating at a few volts d.c. and drawing a few tens of milliamperes. Hence, the power conditioning electronics 44 receive electrical power from the threaded electrical connector 42 and condition the electrical power to operate the LEDs 46.

In one suitable embodiment, the conditioning electronics 44 include a switching power supply (not shown) for converting the a.c. line voltage to a d.c. rectified current adapted for powering the LEDs. Preferably, the switching power supply has a high power factor and low current harmonic distortion. Switching power supplies typically have very low power loss and advantageously include the capability of controlling the output current to optimally drive the LEDs 46. Of course, if the LEDs 46 adequately perform using the power supplied by the threaded socket 18, the conditioning electronics 44 are optionally omitted. In another contemplated embodiment the conditioning electronics 44 are physically integrated into the threaded electrical connector 42 to minimize the size of the source 40.

In one suitable embodiment, the LEDs 46 are white light-emitting LEDs such as white light-emitting phosphor-coated ultraviolet GaN LEDs known to the art. The use of white light-emitting LEDs makes the LED-based lamp 40 a spectrally close retro-fit for the light bulb 12 which typically emits white light. A retro-fit LED-based lamp 40 that employs white light-emitting LEDs can be used for retro-fitting any of the red, yellow, or green balls of the conventional three-color traffic light.

Although employing white-light LEDs enhances retro-fit interchangeability, the use of a white light-emitting source in the traffic light ball 10 is optically inefficient to the extent that the tinted filter or lens 24 blocks and removes light outside of a selected narrow pass-band. For this reason, in another suitable embodiment the LEDs 46 include colored LEDs which produce light predominantly in the selected filter pass-band. Thus, red LEDs are advantageously employed for retro-fitting a red traffic light ball, yellow LEDs are advantageously employed for retro-fitting a yellow traffic light ball, and green LEDs are advantageously employed for retro-fitting a green traffic light ball. Since the selected color conforms with the pass-band of the tinted filter or lens 24, the spectral filtering element need not be removed during the retro-fitting. Because the colored LEDs produce light substantially within the pass-band of the tinted filter or lens 24, the retrofitted source operates with higher optical output efficiency even with the tinted filter or lens 24 in place. Suitable colored LEDs include for example AlGaInP-based LEDs and GaN-based LEDs (with or without phosphor coatings) known to the art. Of course, other LEDs with suitable optical characteristics are also optionally used.

Because colored LEDs inherently define the signal ball light color, if colored LEDs are used the tinted filter, if present, is optionally removed. Similarly, if the lens 24 is tinted, it is optionally replaced by a clear lens. An advantage of performing this removal or replacement is that phantom light reflected by the signal ball without tinted filter is spectrally unaltered. Because the phantom light is not filtered, the reflected light does not appear as spectrally pure red, green, or yellow light and is therefore less likely to confuse roadway users errantly thinking that the traffic light is activated. Another advantage of removing the filtering element is that optical power losses that potentially result from any spectral mismatch between the colored LEDs and the filter pass-band or from non-unity light transmission by the filtering element within the pass band are avoided.

The LED lamp 40 advantageously includes heat sinking to control heat generated by the LED lamp 40. In a suitable embodiment, a heat sink is provided in the form of heat-radiating fins 48 arranged around the power conditioning electronics module 44. In another suitable embodiment, a heat sinking path (not shown) is arranged to conduct heat from the LEDs 46 and the electronics module 44 into the threaded electrical connector 42 and the threaded socket 18. In yet another suitable embodiment a large heat-capacity element (not shown) is arranged within the LED lamp 40 in thermal contact with the heat generating elements to increase the overall heat capacity of the LED lamp 40 and thus reduce the lamp's operating temperature.

The LEDs 46 produce light 60 in a generally forward direction corresponding to the direction of the outwardly directed light beam the traffic signal ball 10 should produce. However, the forwardly directed light 60 can be too narrowly collimated to meet the practical and regulatory requirements for a traffic signal light beam. An optical element 62 is therefore advantageously arranged to disperse or redirect the forwardly directed light 60 in conformance with the traffic signal light optics, i.e. the reflector 22 and the lens 24. Light dispersed by the optical element 62 is received by the optical system exemplarily comprising the reflector 22 and the lens 24 and is substantially collimated by the optical system to produce an outwardly directed light beam with a selected beam spread that meets the practical and regulatory requirements.

In a suitable embodiment, the optical element 62 is a dispersing reflector formed of a light-transmissive encapsulant 66 surrounding the LEDs 46 and having a surface 68 defining the reflector shape, and a reflective material 70 arranged on the surface 68 to enhance the reflectivity. The reflective material 70 is optionally a metallic coating of high reflectivity. For colored LED light, a multiple-layer dielectric stack mirror is optionally used. Such dielectric stacks can be tuned to have very high reflectivity over a selected spectral range coinciding with the colored LED light output. In another contemplated embodiment, the optical element 62 employs total internal reflection at the surface 68 to redirect the light. The optical element 62 reflects the forwardly directed light 60 to produce reflected light 72 generally directed toward the reflector 22 of the traffic light ball 10. For replacing the light bulb 12, the reflected light distribution preferably approximates the point source or line source corresponding to the filament 14.

In the exemplary embodiment of FIGS. 2 and 3, the reflector shape-defining surface 68 is a depression in the encapsulant 66. The reflecting material 70 is a high-reflectivity filling material disposed in the depression. In the retro-fit configuration of FIG. 2, the surface 68 is physically positioned at approximately the same location as the filament 14 of the light bulb 12. In a typical incandescent traffic signal ball 10 arrangement, the filament 14 is positioned at a focal point of the reflector 22. The reflector 22 collects light from the filament 14 disposed in the focal region and forms the light into an outwardly directed light beam. Thus, arranging the optical element 62 in the reflector focal region so as to disperse the LED light 60 away from the focal region suitably adapts the LED light 60 for collimation by the reflector 22.

In one contemplated embodiment, the reflective material 70 includes a partially reflective, partially transmissive element that in addition to producing reflected light 72 also passes a fraction of the forwardly directed light 60 as transmitted light 74. The ratio of reflected light 72 to transmitted light 74 is selected to closely model the light output of the filament 14 of FIG. 1, which as a point or line light source typically generates light directed toward the reflector 22 as well as outwardly directed light which does not impinge on the reflector 22. By including partial light transmission 74, a more accurate retro-fit of the light bulb 12 is obtained, independent of the traffic light or other optical system with which it is to be used. However, in another contemplated embodiment the reflective material 70 is fully reflective so that only the reflected light 72 is produced.

In yet another suitable embodiment of the optical system 62, the reflective surface 68 is replaced by a lensing system (not shown) that couples the generally forwardly directed light 60 with the reflector 22. In still yet another suitable embodiment, a transparent light scattering material (not shown) is arranged at the reflector focus to scatter and disperse light into the reflector 22.

Although the light source 40 of FIGS. 2 and 3 is described with reference to a retro-fit of an incandescent traffic light ball 10, it is not limited thereto. The LED-based traffic light ball is optionally specifically designed for operation with the LED light source 40, rather than for operation with an incandescent light bulb. In this case the traffic light ball optics such as the reflector and the lens are preferably configured to optimally capture and re-direct light generated by the light source 40 to form a light beam having a selected beam spread and other characteristics. The light source 40 is also suitable for use in other lighting systems employing incandescent or other types of light generation. Those skilled in the art will further appreciate that a custom reflector and lens are optionally physically integrated with the LED light source 40 to form a unitary threadedly connectable light source with integral optics that produces a selected light beam, such as a spot beam or a flood beam. Such a unitary threadedly connectable LED-based light source can serve for example as an LED-based replacement for PAR-type incandescent or halogen light bulbs.

Figure 4:
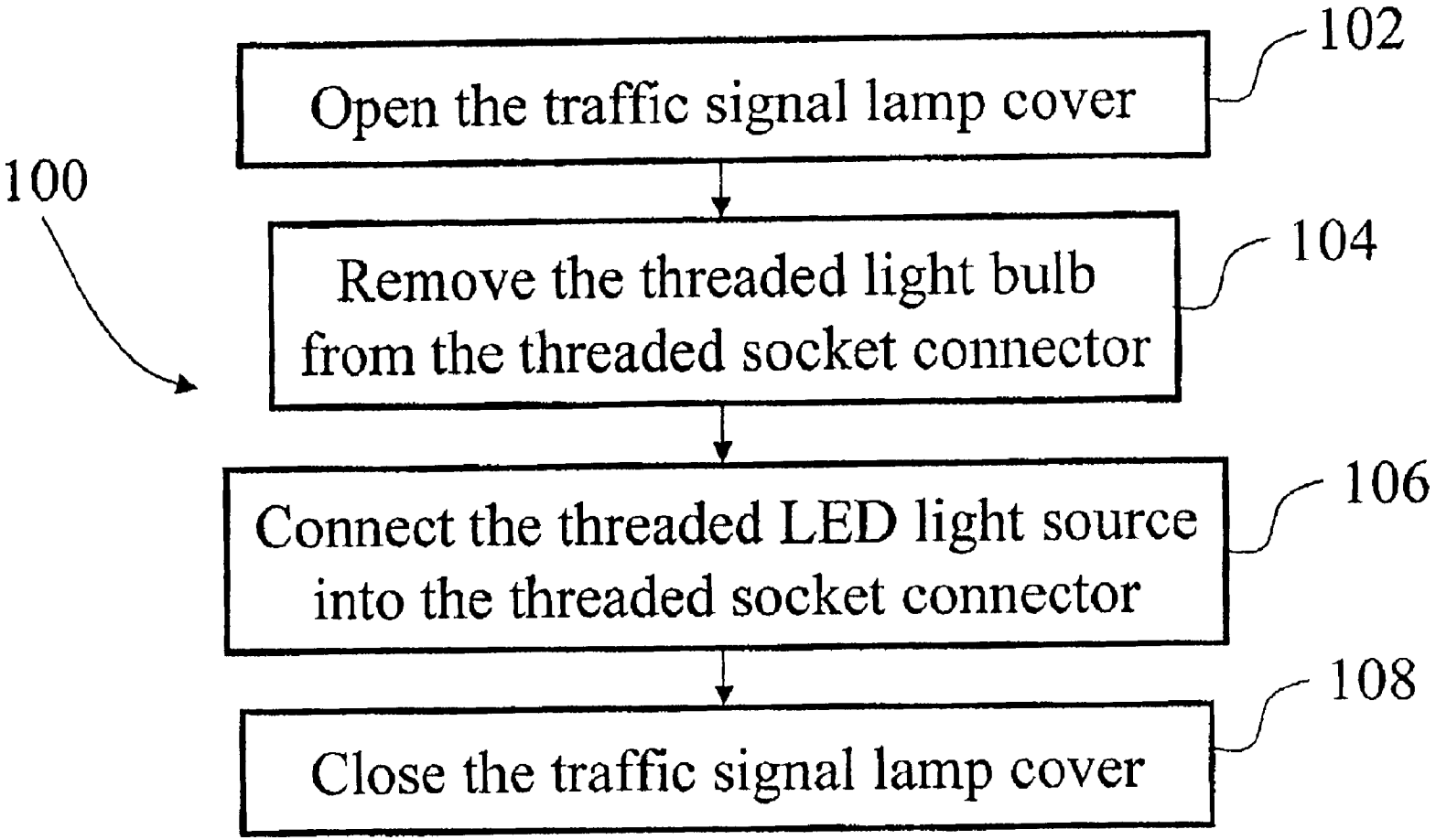
FIG. 4 shows a suitable method for retro-fitting a signal ball employing an incandescent light bulb with a light-emitting diode-based light source in accordance with an embodiment of the invention.

With continuing reference to FIGS. 1–3 and with further reference to FIG. 4, a suitable method 100 for retro-fitting a traffic light ball 10 with the LED light source 40 is described. In a step 102 the traffic signal lamp cover 28 is opened. In a step 104 the threaded light bulb 12 is removed from the threaded socket 18. In a step 106 the threaded LED light source 40 is connected to the threaded socket 18. In a step 108 the traffic signal lamp cover 28 is closed.

Unlike other LED retro-fitting methods, the method 100 preferably does not involve removal or replacement of any component of the traffic light ball 10 except the light bulb 12. In the event of a future failure of the LED-based lamp 40, it can be replaced by another LED-based lamp. Alternatively, the lamp can be re-fitted with an incandescent light bulb, by simply removing the LED light source 40 and re-installing a light bulb into the threaded socket 18.

Even in the case where the LEDs 46 are colored LEDs corresponding to the selected traffic light ball (red, green, or yellow), the tinted filter or lens 24 is optionally not replaced, since the colored LED light output corresponds to the filter pass-band. However, if colored LEDs are used the tinted filter can be removed, or the tinted lens 24 can be replaced by an optically clear lens (steps not shown). Furthermore, the method 100 is optionally performed with the traffic light ball 10 fully energized, since the threaded socket 18 is designed for safe electrical connection while electrically hot. Of course, to fail-safe the retro-fitting, the traffic light is optionally de-energized prior to the retro-fitting.

Since any geometrical filters of the traffic light ball 10 are retained, the same type of LED-based lamp 40 is preferably used regardless of the spatial geometry of the traffic light ball 10. For example, the LED lamp 40 of FIGS. 2 and 3 is suitable for retro-fitting into a round signal ball, a left-turn arrow signal ball, an "X" signal ball, a pedestrian "walk" or "don't walk" signal ball, or the like, because the geometrical filter defining the arrow, "X", etc., is operatively retained. Maintenance crews and traffic departments can maintain a single type of LED-based lamp in stock which is suitable for installation into traffic light balls of various colors and geometries. If colored LEDs (rather than white light-emitting LEDs) are used in the LED lamp 40, separate stocks of the red, yellow, and green LED-based lamps are preferably maintained.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A traffic signal ball producing a light output, the traffic signal ball comprising:

a lamp including:

a plurality of LEDs, an optical element arranged to disperse forwardly directed light produced by the LEDs, the optical element being partially reflective and partially transmissive, that portion of forwardly directed light passing through the optical element defining a direct light contribution to the light output, and a threaded electrical connector, and a collimating reflector defining a reflector focus, the optical element being disposed at about the reflector focus such that the dispersed light is substantially collimated by the collimating reflector to define a reflected light contribution to the light output.

2. The traffic signal ball as set forth in claim 1, wherein the collimating reflector includes:

a parabolic reflector arranged to receive and substantially collimate at least a portion of light dispersed by the optical element.

3. The traffic signal ball as set forth in claim 1, further including:

a lens arranged to receive light collimated by the collimating reflector.

4. The traffic signal ball as set forth in claim 1, further including:

one of a filter and a tinted lens for spectrally filtering the light light output.

5. The traffic signal ball as set forth in claim 1, wherein the collimating reflector is adapted to operate with an incandescent light bulb.

6. The traffic signal ball as set forth in claim 5, wherein a ratio of the light dispersed by the optical element to the direct light contribution is selected to correspond to light output of a filament of said incandescent light bulb.

7. The traffic signal ball as set forth in claim 1, wherein a ratio of the light dispersed by the optical element to the direct light contribution is selected to approximate one of a point light source and a line light source.

8. An LED-based light source comprising:

a threaded electrical connector arranged to receive electrical power;

power converting electronics that receive the electrical power and convert the electrical power to converted power;

a plurality of LEDs arranged to receive the converted power, the LEDs producing a generally forwardly directed first light beam responsive to receipt of the converted power, a light dispersing element arranged at a focal region of a collimating reflector, the light dispersing element intercepting and transforming the first light beam into dispersed light emanating from the focal region; and an optical system including the collimated reflector arranged to focus dispersed light emanating from the focal region into an output light beam having selected beam characteristics.

9. The LED-based light source as set forth in claim 8, wherein the collimating reflector is arranged to substantially collimate dispersed light emanating from the focal region, and the optical system further includes a lens arranged to receive the substantially collimated light.

10. The LED-based light source as set forth in claim 9, wherein the threaded electrical connector, the plurality of LEDs, the light dispersing element, the collimating reflector, and the lens comprise a unitary threadedly connectable light source.

11. The LED-based light source as set forth in claim 9, further including:

a heat sinking means for controlling heat generated by the light-emitting diode-based light source.

12. A lamp for use in a light producing apparatus having a socket through which power is supplied to the lamp, said socket holding the lamp, and a collimating reflector that directs light outwardly from the light producing apparatus, said lamp comprising:

a connector by which the lamp is installed in the socket;

a plurality of LEDs electrically connected to the connector; and a partially light-transmissive and partially light-reflective redirection optical element arranged at about a focal position of the collimating reflector when the lamp connector is installed in the socket, the redirection optical element (i) partially reflecting light emitted from the plurality of LEDs into the collimating reflector and (ii) partially transmitting light emitted from the plurality of LEDs, wherein the partially reflected light and the partially transmitted light together approximate one of a point light source and a line light source.

13. The lamp as set forth in claim 12, wherein the connector is a threaded connector adapted to screw into the socket.

14. The lamp as set forth in claim 12, wherein the connector, the LEDs, and the redirection element are physically integrated into a single mechanically rigid apparatus.

* * * * *